US006637419B1

(12) United States Patent
Troncoso, Jr. et al.

(10) Patent No.: US 6,637,419 B1
(45) Date of Patent: Oct. 28, 2003

(54) CAPSULE ADAPTED FOR USE WITH AN ARCHERY ARROW REST

(76) Inventors: Fernando V. Troncoso, Jr., 16990 Wildwood Dr., Montrose, CO (US) 81401; Vincent Troncoso, 1665 Hermosa Ct., Montrose, CO (US) 81401

( * ) Notice: Subject to any disclaimer, the term of this patent is extended or adjusted under 35 U.S.C. 154(b) by 0 days.

(21) Appl. No.: 09/746,417

(22) Filed: Dec. 21, 2000

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS 4,686,956 A * 8/1987 Troncoso
5,490,491 A * 2/1996 Troncoso ..... 124/44.5
5,722,381 A * 3/1998 Mizek ..... 124/44.5
6,050,251 A * 4/2000 Harwath et al. ..... 124/44.5

* cited by examiner

*Primary Examiner*—John A. Ricci

(57) ABSTRACT

A spring loaded capsule that accepts a rotatable shaft upon which a launcher arm or other type of arrow support mechanism is mounted. The capsule includes a spring for exerting a biasing force against the rotatable shaft and includes a mechanism for limiting the rotation of the shaft in response to the spring bias. The capsule may be used interchangeably with a variety of similarly sized shafts and a variety of launcher arms.

18 Claims, 3 Drawing Sheets

CAPSULE ADAPTED FOR USE WITH AN ARCHERY ARROW REST

FIELD OF THE INVENTION

The present invention generally relates to archery, and more particularly to a mechanism for providing resiliently biased deflection for an arrow support arm of an archery arrow rest.

BACKGROUND OF THE INVENTION

Archery bows, such as compound bows, conventionally possess a handle riser section generally where an archer grasps the bow with one of the archer's hands. The handle riser section includes a window section through which an arrow extends when the arrow is in a "ready-to-draw-and-fire position", when the arrow is drawn rearwardly as the bowstring is drawn, and momentarily after release of the bowstring and during the initial firing of the arrow.

When an arrow is shot and released, the arrow both bends and is thrust downwardly in a porpoising style. A number of arrow rests have been designed to help absorb any downward flexing or thrust of the arrow in order to improve arrow flight accuracy. Many of these arrow rests include a launcher arm that is rotatably mounted to the bow and which extends upwardly and forwardly in the window. One example of a launcher arm is a single piece of thin metal, plastic, or TEFLON® having a notched upper end for cradling the shaft of the arrow. Another type of launcher arm includes a pair of spaced prongs, the upper tips of which are adapted to receive and support the shaft of the arrow therebetween. The launcher arms are designed to provide free clearance of the arrow vanes or feathers when the arrow is shot and released.

Sometimes a launcher arm is fashioned so that the launcher arm itself resiliently deflects when the arrow is shot, and sometimes a rigid launcher arm is fixedly mounted on a rotatable shaft which is subject to a spring bias. The latter types of systems include some mechanism for biasing the launcher arm to an upper or highest position, as well as a limit or stop mechanism for preventing the shaft from rotating beyond a particular arcuate position. With such limit mechanisms, when an arrow is shot, the downward flexing or thrust of the arrow forces the launcher arm downwardly, which rotates the shaft against the spring bias, and when the arrow ceases to flex or thrust downwardly onto the launcher arm, the spring bias rotates the shaft and the launcher arm back to a particular stop position where the launcher arm has an upper or highest position. In more sophisticated launcher arm systems, the degree of spring bias may be selectively adjusted, and the stop position may be selectively adjusted.

The launcher arm systems previously described have generally been known as "arrow rests". Early, simple arrow rests might comprise simply a finger or a launcher arm that is screwed, glued or otherwise affixed to the bow in the region of the window section. Later, more sophisticated arrow rests might include spring biasing mechanisms as well as mechanisms to adjust the forward/rearward, upward/downward, and left/right position of the finger or launcher arm in the window section of the bow.

The most common commercially available arrow rests include a rotatable shaft that is generally horizontally positioned in the window section of the bow with a launcher arm generally radially extending from one end of the rotatable shaft. A variety of launcher arms may be mounted on the rotatable shaft for rotation therewith. Usually, the launcher arm is removably attached to an end of the rotatable shaft.

Also, manufacturers of arrow rests often use a standard sized rotatable shaft for a variety of arrow rests.

SUMMARY OF THE INVENTION

The present invention generally relates to a spring loaded capsule that accepts a rotatable shaft upon which a launcher arm or other type of arrow support mechanism is mounted. The capsule includes a spring for exerting a biasing force against the rotatable shaft and includes a mechanism for limiting the rotation of the shaft in response to the spring bias. The capsule may be used interchangeably with a variety of similarly sized shafts and a variety of launcher arms.

BRIEF DESCRIPTION OF THE DRAWINGS

The invention will be described with reference to the accompanying drawings wherein.

DESCRIPTION OF A PREFERRED EMBODIMENT

Figure 1:
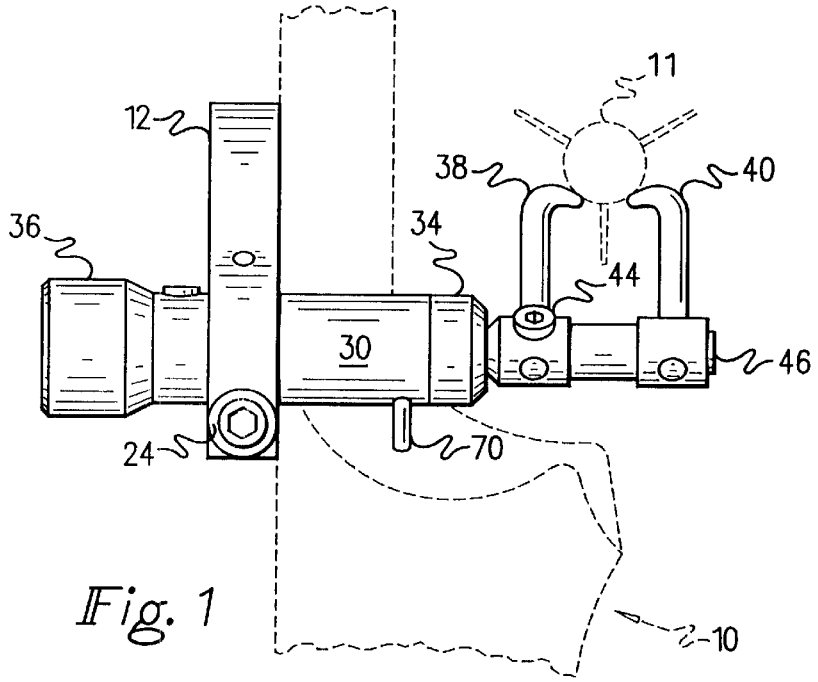
FIG. 1 is a schematic rear elevation of an arrow rest utilizing the capsule in accordance with one embodiment of the present invention.
Figure 2A:
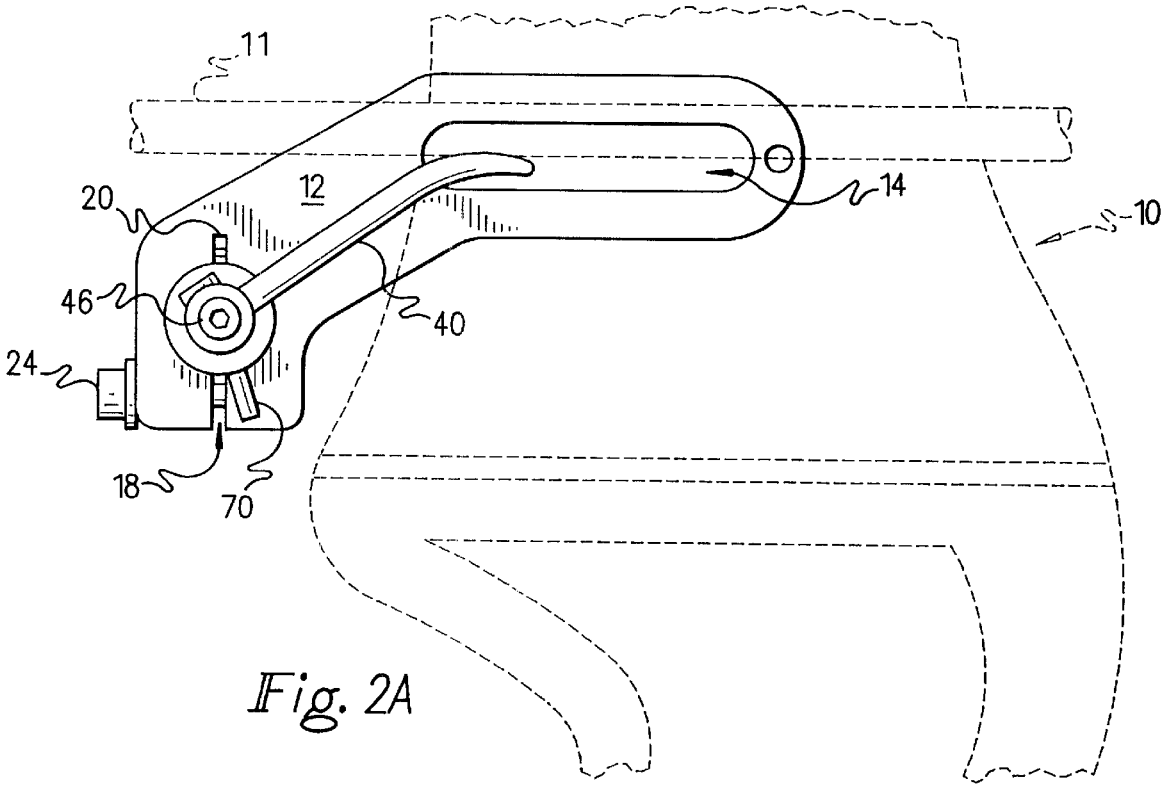
FIG. 2A is a schematic side elevation of the arrow rest as shown in FIG. 1.
Figure 2B:
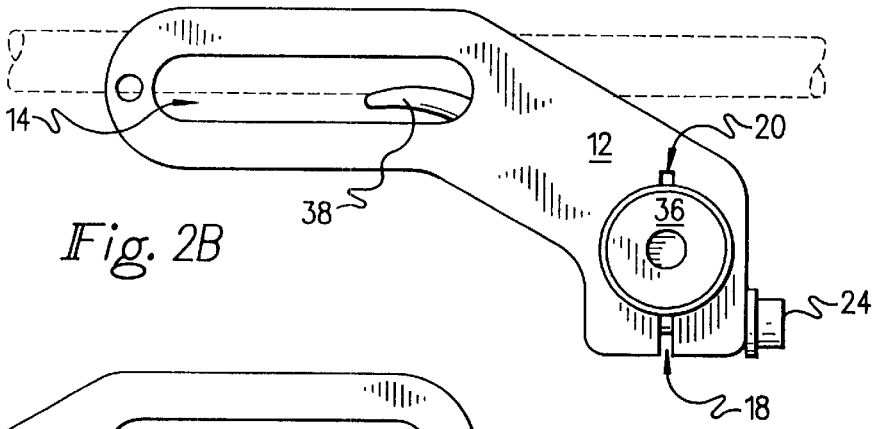
FIG. 2B is a schematic side elevation of the arrow rest as shown in FIGS. 1 and 2A, from the side opposite the side shown in FIG. 2A.
Figure 3A:
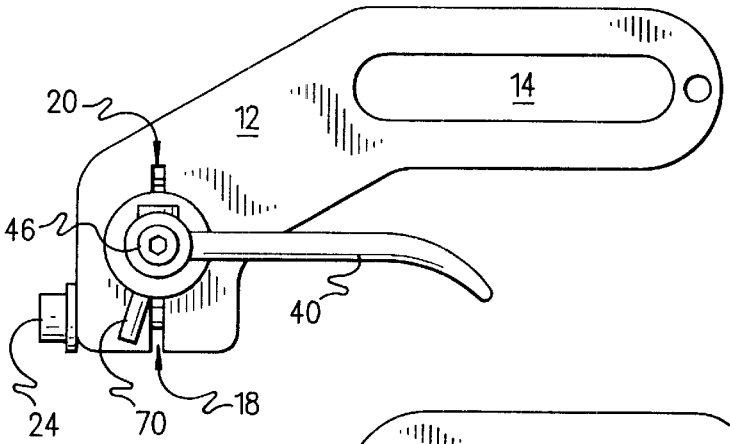
FIG. 3A is a schematic side elevation of the arrow rest as shown in FIG. 2A, after the arrow has been fired, showing a downward movement and rotation of the launcher arm.
Figure 3B:
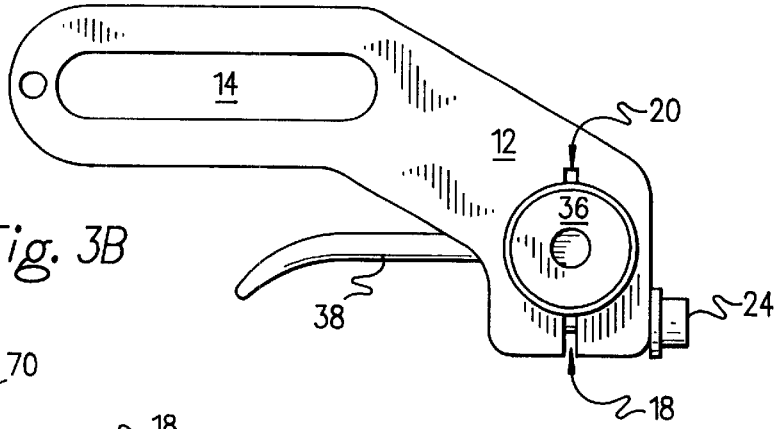
FIG. 3B is a schematic side elevation of the arrow rest as shown in FIG. 3A, from a side opposite to that shown in FIG. 3A.
Figure 4:
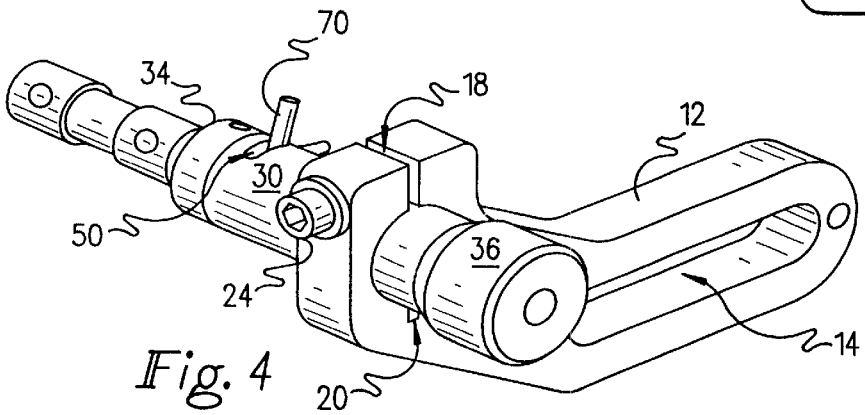
FIG. 4 is a perspective view of the arm rest shown in FIG. 1.

The present invention will be described with reference to the accompanying drawings, wherein like reference numerals refer to the same item. There as shown in FIG. 1 in phantom lines an archery bow 10 which may be a compound bow or other type of bow. The portion of the bow 10 as shown in FIGS. 1 and 2A is generally known as the handle riser section, which includes an arrow window in which an arrow 11 is adapted to be disposed immediately prior to drawing the arrow, during the drawing of the arrow, and during the firing of the arrow from the bow 10.

The arrow rest assembly of the preferred embodiment of the present invention may broadly be construed as including a mounting bracket, a capsule, a rotatable shaft, and a launcher arm.

An arrow rest utilizing the capsule of the present invention may be mounted directly to the handle riser section of the bow 10, may be installed in an overdraw bracket assembly, or most preferably may be employed with a mounting bracket 12. The mounting bracket 12 may be fashioned of a planar piece of metal and may assume a fairly shallow "V" shape, as best shown in FIGS. 2A, 2B, 3A and 3B. One arm of the bracket 12 is elongated and includes a slot 14 therethrough. A conventional screw or bolt (not shown) adapted to extend into a conventional threaded receptacle (not shown) in the handle riser section of the bow 10 may extend through the slot 14. By tightening the screw or bolt, the mounting bracket 12 may be securely clamped against the handle riser section of the bow 10. Since the diameter of the screw or bolt is much smaller than the length of the slot 14, the mounting bracket 12 may be selectively positioned relative to the threaded receptacle in the handle riser section of the bow 10 within the limits of the length of the slot 14. The other arm of the mounting bracket 12 is comparatively short and includes a cylindrical hole 16 therethrough. The mounting bracket is provided with a long slit 18 extending from the cylindrical hole 16 to the distal end of the comparatively short arm of the mounting bracket 12, and with a relatively short slit 20 on the side of the cylindrical hole 16 diametrically opposite to the long slit 18. The mounting bracket 12 also possesses a threaded hole 22 extending from a side thereof through the long slit 18 and includes a screw 24 that extends into the threaded hole 22, whereby tightening of the screw 24 will draw together the regions of the mounting bracket 12 in the vicinity of the long slit 18, which effectively causes the cylindrical hole 16 to have a slightly smaller diameter.

The capsule of the present invention is adapted to be slidably received within and selectively clamped within the cylindrical hole 16 of the mounting bracket 12.

The launcher arm in the preferred embodiment of the present invention is preferably fashioned as a pair of spaced prongs 38, 40 that extend forwardly and upwardly in the window region as best shown in FIG. 2A. The prongs 38, 40 are preferably fashioned of a rigid material and may be coated with plastic or TEFLON® to help reduce frictional engagement (and associated noise) of the prongs 38, 40 with the arrow shaft when the arrow 11 is drawn and fired. The tips of the prongs 38, 40 are tapered and rounded and are curved toward the adjacent prong 38, 40. As best shown in FIG. 1, the shaft or spine of the arrow 11 is adapted to rest upon and to be centered above the converging tips of the prongs 38, 40.

It should be appreciated that instead of a pair of laterally spaced prongs, for example, a single finger or launcher arm having a forked or crotched upper end may be utilized to help cradle the arrow shaft in a selected position. Also, although a rigid launcher arm is preferred, it is within the scope of the present invention that a resiliently flexible launcher arm may also be utilized. It should be further appreciated the wide variety of launcher arms having different shapes, compositions, and degrees of flexibility may be effectively utilized in connection with the present invention.

In the preferred embodiment, the launcher arm includes a generally cylindrical base preferably integrally formed on an end of a rotatable cylindrical shaft 42. A pair of set screws 44,46 extend into the base of the launcher arm to clamp the lower ends of the prongs 38, 40 in a selected, fixed position with respect to the rotatable cylindrical shaft 42. The other end of the rotatable shaft is received by and in the capsule.

Figure 5:
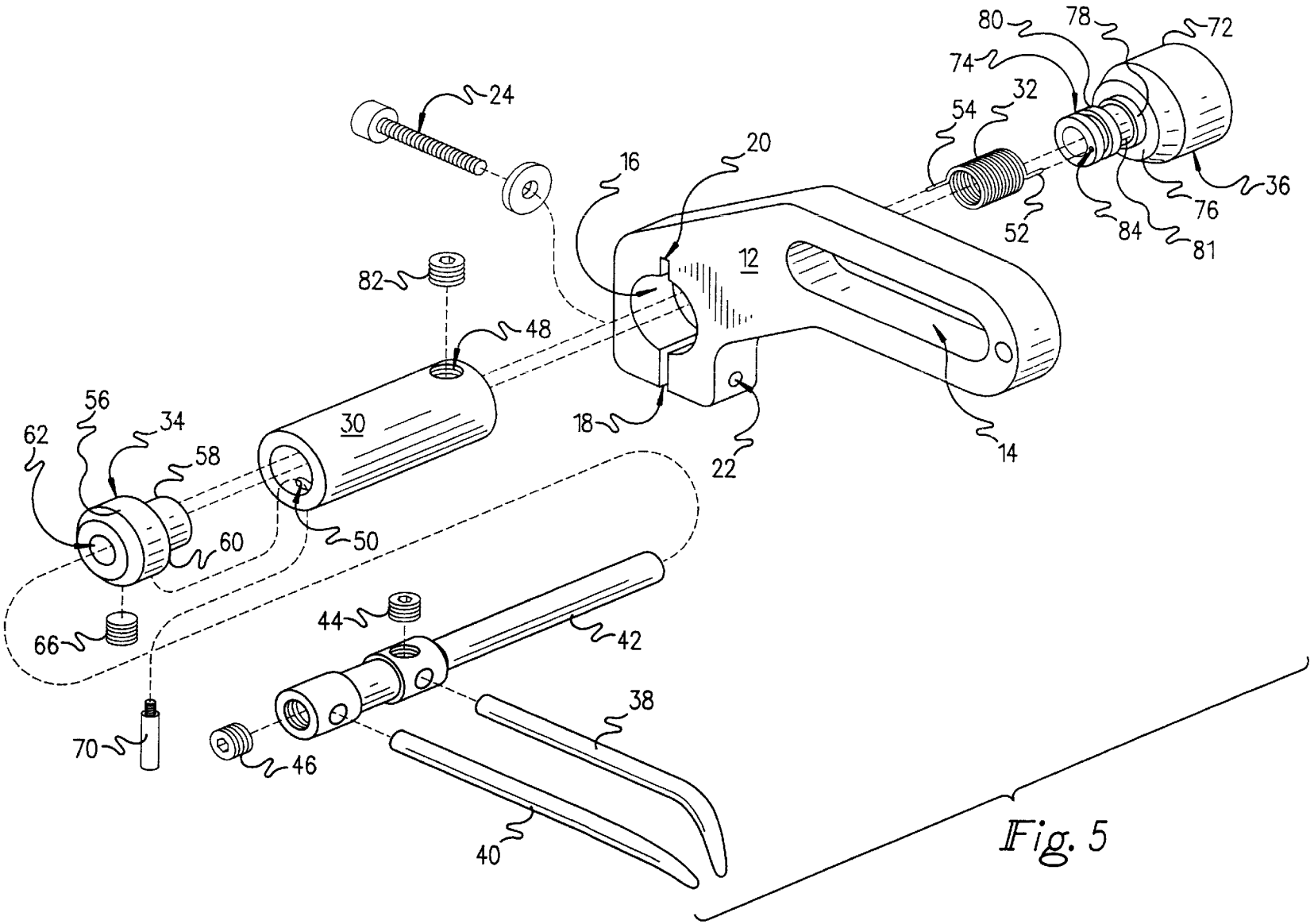
FIG. 5 is an exploded perspective view of the arrow rest illustrated in FIG. 1.

As best shown in FIG. 5, the capsule preferably generally includes a barrel 30, a torsion spring 32, a first end cap 34, and a second end cap 36.

The barrel 30 comprises a tube having substantially cylindrical, concentric outer and inner peripheral surfaces. One end of the barrel 30 possesses a threaded hole 48 radially extending therethrough, and the other end of the barrel 30 possesses an arcuate slot 50 extending therethrough. Preferably, the arcuate range of the limits of the slot 50 is between approximately 45–90 degrees, and more preferably, approximately 60–70 degrees.

The spring 32 preferably comprises a coiled torsion spring in a helical configuration, with the outer diameter of the spring 32 being slightly smaller than the internal diameter of the barrel 30. The inner diameter of the spring 32 is slightly greater than the diameter of the rotatable shaft 42, and is adapted to slidably receive an end of the rotatable shaft 42 extending within the barrel 30. Preferably, the spring 32 is fashioned of corrosion resistant piano wire. Each end of the spring 32 includes a finger 52, 54 generally projecting in a longitudinal direction, as best shown in FIG. 5.

As best shown in FIG. 5, the first end cap 34 includes a substantially cylindrical head portion 56 and a substantially cylindrical nipple portion 58 defining a lip region 60 therebetween. The nipple portion 58 of the first end cap 34 is designed to be snugly disposed within the hollow interior of the barrel 30 such that the lip region 60 of the first end cap 34 seats against the longitudinal end of the barrel 30. The outer diameter of the cylindrical nipple portion 58 is approximately equal to the inner diameter of the barrel 30. A borehole 62 centrally extends through the first end cap 34 and possesses a diameter slightly larger than the diameter of the rotatable shaft 42. The head portion 56 includes a threaded hole radially extending therethrough (not shown) and is adapted to receive a set screw 66 which may be rotated to selectively tighten against and clamp the rotatable shaft 42 in a selected longitudinal position with respect to the first end cap 34. It will be appreciated that when the set screw 66 is tightened to clamp the rotatable shaft 42 at a selected longitudinal position with respect to the first end cap 34, the first end cap 34 rotates concurrently with the rotatable shaft 42. The nipple portion 58 includes a radially extending threaded hole (not shown), which is adapted to receive a cylindrical pin 70 threaded on one end thereof. The pin 70 is sized and adapted to extend into and arcuately rotate within the arcuate slot 50 in the barrel 30. The distal end of the nipple portion 58 of the first end cap 34 includes a hole longitudinally extending therein (not shown), which is adapted to receive one of the finger extensions 54 of the coiled spring 32.

The first end cap 34 may rotate with the shaft 42, substantially about the longitudinal axis of the barrel 30, and with respect to the barrel 30, but such rotation is arcuately limited by the limits of movement of the pin 70 within the slot in the barrel 30.

The second end cap 36 includes a head portion 72 and a nipple portion 74, which define a lip region 76 therebetween. The nipple portion 72 includes a pair of spaced ring sections 78, 80 defining an annular depression 82 therebetween. The outer diameter of the ring sections 78, 80 of the nipple portion 74 possess a diameter approximately equal to the inner diameter of the barrel 30. A set screw 82 is adapted to threadably extend through the threaded hole 48 radially extending through the barrel 30, such that when the set screw 82 is tightened, the set screw 82 is disposed between the ring sections 78, 80 of the nipple portion 84 of the second end cap 36, within the annular depression 82. Further tightening of the set screw 82 clamps the second end cap 36 within the barrel 30. A longitudinal hole 84 extends in the distal end of the nipple portion 74 of the second end cap 36 and is adapted to receive the other longitudinally extending finger 52 of the coiled spring 32.

The longitudinal lengths of the barrel, the coil spring 32, the nipple portion 58 of the first end cap 34, and the nipple portion 74 of the second end cap 36 are selected such that when the first end cap 34 is seated such that its lip region 60 is seated against the associated longitudinal end of the barrel 30 and the lip portion 76 of the second end cap 36 is snugly seated against the opposing longitudinal end of the barrel 30, the longitudinally extending fingers 52, 54 of the coiled spring 32 will extend into the holes longitudinally extending into the distal ends of the associated nipple portions 74, 58 of the second end cap 36 and the first end cap 34, respectively.

The degree of torsional tension produced by the coil spring 32 may be selectively varied by rotating the second end cap 36. In operation, the set screw 82 extending within the annular depression 80 of the nipple portion 74 of the second end cap 36 is slightly loosened whereby the second end cap 36 is free to rotate about the longitudinal axis of the barrel 30 with respect to the barrel 30, but whereby the longitudinal movement of the second end cap 36 with respect to the barrel 30 is constrained. By rotating the second end cap 36 (with the finger 52 of the coil spring 32 extending into the longitudinal hole 84 extending in the distal end of the nipple portion 74 of the second end cap 36), the finger 52 is rotated about the longitudinal axis of the helically shaped coil spring 32, thereby creating a tortional bias in one of two rotational directions. Further rotation of the finger 52 in the same direction increases the tension. When the desired tension in the desired rotational direction is achieved, the second end cap 36 is held in place relative to the barrel 30, and the set screw 82 is tightened to clamp the second end cap 36 against the barrel 30, so as to selectively fix the rotational position of the second end cap 36 relative to the barrel 30 and so as to create a selective rotational tension in the coil spring 32.

The tension in the coil spring 32 is translated to the other finger 54 extending into the longitudinal hole in the distal end of the nipple portion 38 of the first end cap 34, whereby the first end cap 34 and the rotatable shaft 42 are rotated to a position where the pin 70 is pressed against one extreme end of the slot 50 in the barrel 30. Any rotation of the shaft 42 in a direction whereby the pin 70 moves from such extreme position in the slot 50 would be subject to a resilient, resistive force created by the coil spring 32. Again, the degree of magnitude of such resilient resistive force may be selectively adjusted by rotation and clamping of the second end cap 36 in the manner previously described.

In a further, more broadly described operation of the present invention, the barrel 30 of the capsule is placed in the cylindrical hole 16 of the mounting bracket 12 and is selectively, fixedly positioned within the cylindrical hole 16 by tightening the set screw 24. Such a position is determined by whether the upper end of the launcher arm (in the preferred embodiment, the tips of the prongs 38, 40) is disposed at a preferred vertical and horizontal position in the window of the handle riser section of the bow 10. The vertical position may be selected by rotating the mounting bracket 12 against the handle riser section of the bow 10, by rotating the barrel 30 within the cylindrical hole 16 in the mounting bracket 12, or by rotating the rotatable shaft 42 relative to the first end cap 34. Likewise, the horizontal position of the upper end of the launcher arm may be adjusted by a changing longitudinal position of the barrel 30 in the cylindrical hole 16 of the mounting bracket 12, or by adjusting the longitudinal position of the rotatable shaft 42 within the first end cap 34.

Thus, it should be appreciated that the capsule and arrow rest of the present invention may be effectively used with a wide variety of fingers and launcher arms to provide for convenient and exact positioning of the upper end of the finger/launcher arm in the window, and to provide a wide range of selectively variable resilient force against the rotatable shaft 42 and the finger/launcher arm.

Although particular embodiments of the present invention are described and illustrated herein, it should be recognized that modifications and variations may readily occur to those skilled in the art and that such modifications and variations may be made without parting from the spirit or scope of the present invention. Consequently, the present invention as claimed below may be practiced otherwise than as specifically described above.

We claim:

1. A capsule adapted for use with an archery arrow rest including a rotatable shaft and an arrow support arm connected to the shaft, said capsule comprising:

(a) a barrel possessing a substantially hollow interior and possessing two substantially open, opposed ends in communication with the hollow interior;

(b) a tension spring housed substantially within the hollow interior of said barrel;

(c) a first end cap disposed at a first open end of said barrel, rotatable with respect to said barrel, and operatively connected to said spring such that any tension on said spring acts upon said first end cap to rotationally bias said first end cap relative to said barrel;

(d) means for securing the shaft to said first end cap such that said end cap rotates concurrently with the shaft relative to said barrel;

(e) means for limiting the rotational range of said first end cap and the shaft relative to said barrel;

(f) a second end cap disposed at the second opposed end of said barrel and operatively connected to said spring such that selected positioning of said second end cap relative to said barrel causes the tension on said spring to selectively vary.

2. A capsule according to claim 1 further comprising means for selectively maintaining said second end cap at a selected position of movement relative to said barrel.

3. A capsule according to claim 2 wherein said maintaining means comprises a set screw threadably extending through the wall of said barrel and adapted to selectively clamp said second end cap against said barrel.

4. A capsule according to claim 1 wherein the outer peripheral surface of said barrel is substantially cylindrical, wherein the hollow interior of said barrel is substantially cylindrical and substantially concentric with the outer peripheral surface of said barrel, and wherein said spring is coiled in a substantially helical configuration and is substantially concentric with the outer peripheral surface.

5. A capsule according to claim 4 wherein said barrel includes a slot arcuately extending therethrough and wherein said limiting means comprises a pin connected to said first end cap such that said pin concurrently rotates with said first end cap relative to said barrel and wherein said pin substantially radially extends into and is moveable arcuately within the slot in said barrel.

6. A capsule according to claim 4 wherein said first end cap possesses a borehole extending therethrough which is adapted to receive the shaft slidably therethrough, said spring being sized so as to substantially surround a portion of the shaft when the shaft is slidably received through the borehole of said first end cap.

7. A capsule according to claim 6 wherein said securing means comprises a set screw threadably extending through a wall of said first end cap and adapted to selectively clamp the shaft against said first end cap.

8. A capsule according to claim 1 wherein said barrel includes a slot and wherein said limiting means comprises a pin connected to said first end cap such that said pin concurrently rotates with said first end cap relative to said barrel and wherein said pin is adapted to extend into and within is moveable within the slot in said barrel.

9. A capsule according to claim 1 further consisting essentially of means for selectively maintaining said second end cap at a selected position of movement relative to said barrel.

10. A capsule according to claim 9 wherein said maintaining means comprises a set screw threadably extending through the wall of said barrel and adapted to selectively clamp said second end cap against said barrel.

11. An arrow support device adapted for use with an archery bow and adapted for use with an arrow support arm connected to a rotatable shaft, said arrow support device including:

(a) a tubular barrel possessing a substantially cylindrical outer periphery and a substantially cylindrical inner periphery, possessing a substantially longitudinal axis, and possessing a slot extending substantially arcuately therethrough substantially near one longitudinal end thereof and possessing a threaded hole substantially radially extending therethrough substantially near the other longitudinal end thereof;

(b) a substantially helically configured, coiled torsion spring housed substantially within the interior of said barrel and possessing a substantially longitudinal axis, with the longitudinal axis of said barrel being substantially coextensive with the longitudinal axis of said spring when said spring is housed substantially within the interior of said barrel, each end of said spring configured in a substantially longitudinally extending finger;

(c) a pin;

(d) a pair of set screws;

(e) a first end cap including a substantially cylindrical first head portion possessing a substantially longitudinal axis and a substantially cylindrical first nipple portion possessing a substantially longitudinal axis and including a substantially cylindrical first borehole substantially concentrically extending therethrough possessing a substantially longitudinal axis and adapted to receive the shaft, the diameter of said first nipple portion being smaller than the diameter of said first head portion such that a first lip is formed in said first end cap, the substantially longitudinal axes of said first head portion, said first nipple portion, and said first borehole being substantially aligned, the distal end of said first head portion possessing a first threaded hole substantially radially extending therethrough and adapted to receive one of said set screws such that said set screw maybe rotated within said first threaded hole to press forcefully against the shaft when said shaft is received in said first borehole of said first end cap, said first nipple portion possessing a hole substantially longitudinally extending therein adapted to receive one finger of said spring, said first nipple portion also possessing a hole substantially radially therein adapted to receive a first longitudinal end of said pin, said first lip of said first end cap adapted to seat against one longitudinal end of said barrel such that said first nipple portion extends into the hollow interior of said barrel and whereby said pin may extend into the substantially radially extending hole of said first nipple portion and simultaneously extend into the slot in said barrel; and (f) a second end cap including a substantially cylindrical second head portion possessing a substantially longitudinal axis and a substantially cylindrical second nipple portion possessing a substantially longitudinal axis, the diameter of said first nipple portion being smaller than the diameter of said first head portion, such that a second lip is formed on said second end cap, the substantially longitudinal axes of said second head portion and said second nipple portion being substantially aligned, the distal end of said second nipple portion possessing a hole longitudinally extending therein adapted to receive the other finger of said spring, said second lip of said second end cap adapted to seat against the other longitudinal end of said barrel such that said second nipple portion extends into the hollow interior of said barrel and whereby the other of said set screws may extend through said threaded hole in said barrel to press forcefully against said second nipple portion.

12. A capsule adapted for use with an archery arrow rest including a rotatable shaft and an arrow support arm connected to the shaft, said capsule consisting essentially of:

(a) a barrel possessing a substantially hollow interior and possessing two substantially open, opposed ends in communication with the hollow interior;

(b) a tension spring housed substantially within the hollow interior of said barrel;

(c) a first end cap disposed at a first open end of said barrel, rotatable with respect to said barrel, and operatively connected to said spring such that any tension on said spring acts upon said first end cap to rotationally bias said first end cap relative to said barrel;

(d) means for securing the shaft to said first end cap such that said end cap rotates concurrently with the shaft relative to said barrel;

(e) means for limiting the rotational range of said first end cap and the shaft relative to said barrel;

(f) a second end cap disposed at the second opposed end of said barrel and operatively connected to said spring such that selected positioning of said second end cap relative to said barrel causes the tension on said spring to selectively vary.

13. A capsule according to claim 12 wherein the outer peripheral surface of said barrel is substantially cylindrical, wherein the hollow interior of said barrel is substantially cylindrical and substantially concentric with the outer peripheral surface of said barrel, and wherein said spring is coiled in a substantially helical configuration and is substantially concentric with the outer peripheral surface.

14. A capsule according to claim 13 wherein said first end cap possesses a borehole extending therethrough which is adapted to receive the shaft slidably therethrough, said spring being sized so as to substantially surround a portion of the shaft when the shaft is slidably received through the borehole of said first end cap.

15. A capsule according to claim 14 wherein said securing means comprises a set screw threadably extending through a wall of said first end cap and adapted to selectively clamp the shaft against said first end cap.

16. A capsule according to claim 13 wherein said barrel includes a slot arcuately extending therethrough and wherein said limiting means comprises a pin connected to said first end cap such that said pin concurrently rotates with said first end cap relative to said barrel and wherein said pin substantially radially extends into and is moveable arcuately within the slot in said barrel.

17. A capsule according to claim 12 wherein said barrel includes a slot and wherein said limiting means comprises a pin connected to said first end cap such that said pin concurrently rotates with said first end cap relative to said barrel and wherein said pin is adapted to extend into and within is moveable within the slot in said barrel.

18. An arrow support device adapted for use with an archery bow and adapted for use with an arrow support arm connected to a rotatable shaft, said arrow support device consisting essentially of:

(a) a tubular barrel possessing a substantially cylindrical outer periphery and a substantially cylindrical inner periphery, possessing a substantially longitudinal axis, and possessing a slot extending substantially arcuately therethrough substantially near one longitudinal end thereof and possessing a threaded hole substantially radially extending therethrough substantially near the other longitudinal end thereof;

(b) a substantially helically configured, coiled torsion spring housed substantially within the interior of said barrel and possessing a substantially longitudinal axis, with the longitudinal axis of said barrel being substantially coextensive with the longitudinal axis of said spring when said spring is housed substantially within the interior of said barrel, each end of said spring configured in a substantially longitudinally extending finger;

(c) a pin;

(d) a pair of set screws;

(e) a first end cap including a substantially cylindrical first head portion possessing a substantially longitudinal axis and a substantially cylindrical first nipple portion possessing a substantially longitudinal axis and including a substantially cylindrical first borehole substantially concentrically extending therethrough possessing a substantially longitudinal axis and adapted to receive the shaft, the diameter of said first nipple portion being smaller than the diameter of said first head portion such that a first lip is formed in said first end cap, the substantially longitudinal axes of said first head portion, said first nipple portion, and said first borehole being substantially aligned, the distal end of said first head portion possessing a first threaded hole substantially radially extending therethrough and adapted to receive one of said set screws such that said set screw maybe rotated within said first threaded hole to press forcefully against the shaft when said shaft is received in said first borehole of said first end cap, said first nipple portion possessing a hole substantially longitudinally extending therein adapted to receive one finger of said spring, said first nipple portion also possessing a hole substantially radially therein adapted to receive a first longitudinal end of said pin, said first lip of said first end cap adapted to seat against one longitudinal end of said barrel such that said first nipple portion extends into the hollow interior of said barrel and whereby said pin may extend into the substantially radially extending hole of said first nipple portion and simultaneously extend into the slot in said barrel; and (f) a second end cap including a substantially cylindrical second head portion possessing a substantially longitudinal axis and a substantially cylindrical second nipple portion possessing a substantially longitudinal axis, the diameter of said first nipple portion being smaller than the diameter of said first head portion, such that a second lip is formed on said second end cap, the substantially longitudinal axes of said second head portion and said second nipple portion being substantially aligned, the distal end of said second nipple portion possessing a hole longitudinally extending therein adapted to receive the other finger of said spring, said second lip of said second end cap adapted to seat against the other longitudinal end of said barrel such that said second nipple portion extends into the hollow interior of said barrel and whereby the other of said set screws may extend through said threaded hole in said barrel to press forcefully against said second nipple portion.

* * * * *